US009377187B2

(12) United States Patent
Chen

(10) Patent No.: US 9,377,187 B2
(45) Date of Patent: Jun. 28, 2016

(54) ADJUSTABLE VORTEX FLAME DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 273 days.

(21) Appl. No.: 14/106,960

(22) Filed: Dec. 16, 2013

(65) Prior Publication Data

US 2015/0167964 A1 Jun. 18, 2015

(51) Int. Cl.

| | |
|---|---|
| ***F23C 7/00*** | (2006.01) |
| ***F23D 3/04*** | (2006.01) |
| ***F23D 3/20*** | (2006.01) |

(52) U.S. Cl.

CPC . *F23C 7/002* (2013.01); *F23D 3/04* (2013.01); *F23D 3/20* (2013.01)

(58) Field of Classification Search

CPC ..... F23C 7/002; F23C 7/004; F23C 7/006; F23C 7/02; F23C 7/008; F23D 3/20; F23D 3/04

See application file for complete search history.

(56) References Cited

U.S. PATENT DOCUMENTS

| | | | | |
|---|---|---|---|---|
| 7,097,448 | B2 | 8/2006 | Chesney | |
| D621,873 | S | 8/2010 | Tsai | |
| 2012/0006316 | A1* | 1/2012 | Shimek | F23C 7/004 126/519 |
| 2013/0252188 | A1 | 9/2013 | Chen | |

FOREIGN PATENT DOCUMENTS

| | | | |
|---|---|---|---|
| CN | 202303367 U | | 7/2012 |
| GB | 406134 | * | 2/1934 |
| TW | 431289 U | | 6/2012 |

* cited by examiner

*Primary Examiner* — Alfred Basichas

(74) *Attorney, Agent, or Firm* — Alan D. Kamrath; Kamrath IP Lawfirm, P.A.

(57) ABSTRACT

An adjustable vortex flame device includes a control head. The control head delimits an opening and includes a flow guiding mechanism including a plurality of vanes and a control mechanism delimiting a hole. The plurality of vanes is disposed along a circumference of the opening one after another, with two adjacent vanes including a spiral air passage formed therebetween. The hole has a diametrical size which varies with respect to different sizes of vortex flames of the adjustable vortex flame device. The hole corresponds to and is in communication with the opening. The hole has a smaller diametrical size than the opening. A hollow and transparent shield is disposed above the control head and adjacent to the control mechanism. The shield delimits a space in communication with the hole of the control mechanism.

16 Claims, 13 Drawing Sheets

ADJUSTABLE VORTEX FLAME DEVICE

BACKGROUND OF THE INVENTION

1. Field of the Invention

The present invention relates to a vortex flame device and, particularly, to an adjustable vortex flame device.

2. Description of the Related Art

U.S. Pat. No. 7,097,448 discloses a vortex type gas lamp for producing an upwardly directed vortex flame inside a surrounding and confined boundary of a rotating body of air. An interface is located between the body of air which is devoid of gas and a central region of gas which is bounded by the interface during the operation of the gas lamp. All of the combustion of gas substantially occurs inside the interface. The gas lamp has a central axis and includes a base supplying combustible gas without air at and nearly adjacent to the central axis. The gas lamp further includes a shield including first and second axially extending sections structurally attached to the base in a fluid sealing relationship. The first and second sections are substantially identical and transparent to light, and each includes an impermeable wall having an arcuate inner surface and an arcuate outer surface. Furthermore, each of the first and second sections has first and second edges extended axially. The gas lamp yet further includes the first and second walls alternately overlapping one another. The first and second walls are adjacent to their edges and are spaced from one another to form tangentially directed ports, thereby forming an axially extending mixing chamber open at its side only through the ports. Furthermore, the first and second sections are arranged at the base where they surround the entry of combustible gas and which receives air for combustion only through the ports. Whereby, the combustion of the gas results in a flame spaced from the inner surfaces, and the peripheral body of air is devoid of gas entering through the ports. Generally, if no air is supplied for combustion, a flame will extinguish. Unfortunately, it is not easy to prevent excess air from entering the chamber through the ports and to create a stable swirling flame during combustion, since the ports are directly open to air. If the device is placed under an environment with wind, the height and the swirling pattern of the flame are greatly disturbed by excess airflow through the ports due to wind. Notwithstanding, the base of the chamber is also heated during combustion, and, if there is not enough airflow through the base to provide cooling, the top surface of the base can be very hot and not safe to touch.

U.S. Design Patent No. D621,873 discloses a fire tornado lamp including a base and a shield. The base includes a plurality of ports disposed circumferentially. The shield is transparent to light and hollow and includes a passage extended therein. The base and the shield are connected to each other. Each port extends radially with respect to and is in communication with the passage defined in the shield. Each port is so configured that it induces air into the passage in a direction substantially tangential to a circumference of the passage. Likewise, it is not easy to preclude excess air from entering through the ports, and the flame is susceptible to wind. Also, the guided air flow that provides for combustion and cooling can only enter the chamber through the ports above the bottom of the burning flame at an angle perpendicular to the flame direction. This configuration can generate a swift swirling flame and can induce strong convection during combustion. However, it is difficult to control the swirling speed and pattern of the flame, and the base of the device can be very hot.

A user can't interact with the two set forth devices to adjust the size of a vortex flame thereof.

The present invention is, therefore, intended to obviate or at least alleviate the problems encountered in the prior art.

SUMMARY OF THE INVENTION

According to the present invention, an adjustable vortex flame device includes a control head. The control head delimits an opening and includes a flow guiding mechanism including a plurality of vanes and a control mechanism delimiting a hole. The plurality of vanes is disposed along a circumference of the opening one after another, with two adjacent vanes including a spiral air passage formed therebetween. The hole has a diametrical size which varies with respect to different sizes of vortex flames of the adjustable vortex flame device. The hole corresponds to and is in communication with the opening. The hole has a smaller diametrical size than the opening. A hollow and transparent shield is disposed above the control head and adjacent to the control mechanism. The shield delimits a space in communication with the hole of the control mechanism.

It is therefore an object of the present invention to provide a vortex flame device that a user can interact to adjust the size of a vortex flame thereof.

Other objects, advantages, and new features of the present invention will become apparent from the following detailed description of the invention when considered in conjunction with the accompanied drawings.

DETAILED DESCRIPTION OF THE INVENTION

Figure 5:
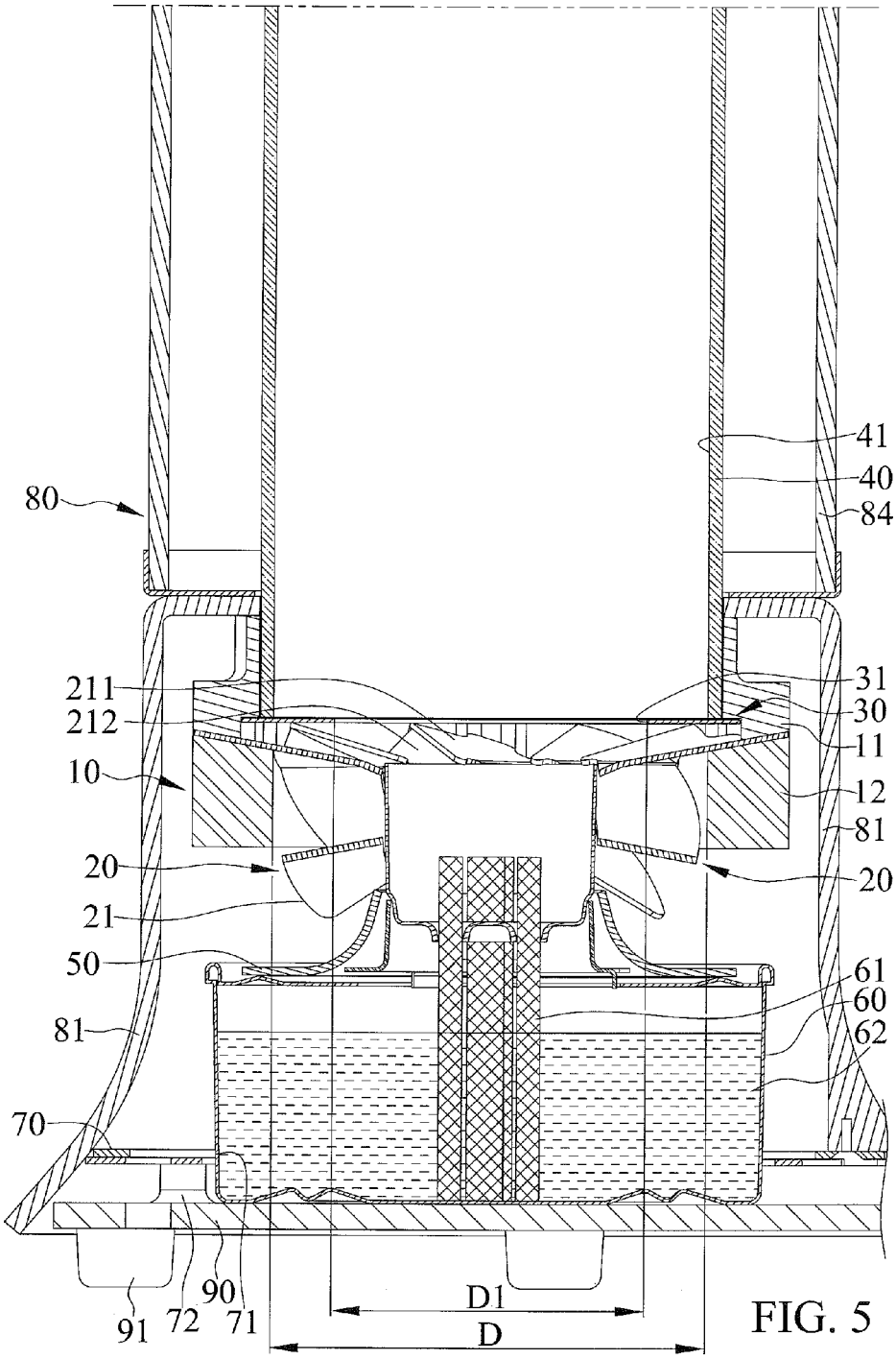
FIG. 5 is a partial cross-sectional view of the adjustable vortex flame device of FIG. 1.
Figure 6:
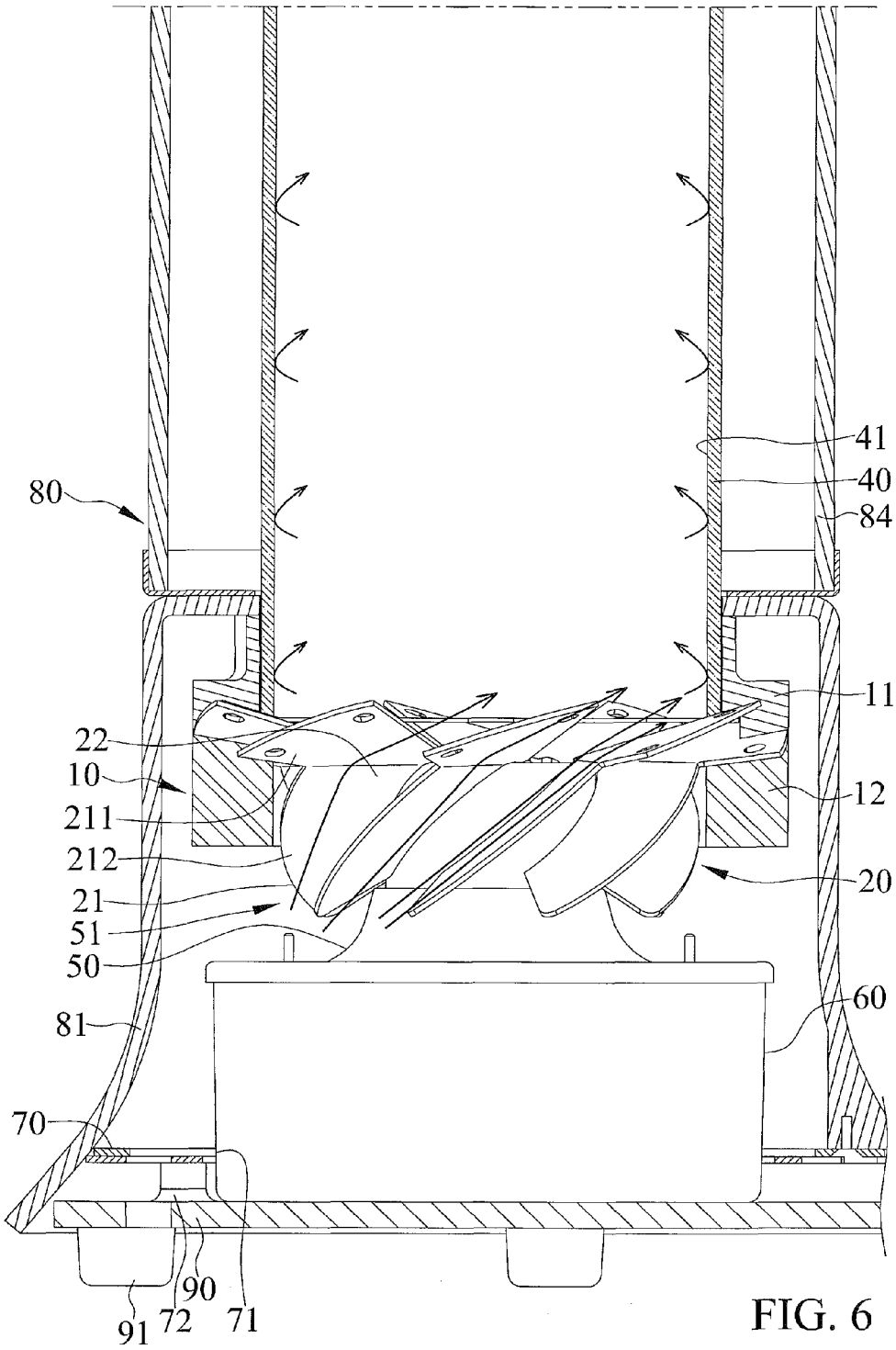
FIG. 6 is another partial cross-sectional view of the adjustable vortex flame device of FIG. 1 and arrows indicate air flows.

FIGS. 1 through 7 show an adjustable vortex flame device in accordance with a first embodiment of the present invention. The adjustable vortex flame device includes a control head 10. The control head 10 delimits an opening 13 with a diametrical size D and includes a flow guiding mechanism 20 including a plurality of vanes 21 and a control mechanism 30 delimiting a hole 31. Referring to FIG. 5, D1 indicates a diametrical size of the hole 31. The control head 10 includes a base having an inner periphery thereof delimiting the opening 13. The flow guiding and control mechanisms 20 and 30 are mounted on the base.

The base includes a first base member 11 and a second base member 12 joined to the first base member 11. The opening 13 defines a first orifice 111 extending through the first base member 11 and a second orifice 121 extending through the second base member 12, respectively. The first base member 11 has a first engaging end 112, and the second base member 12 has a second engaging end 122 engaging with the first engaging end 112. The first engaging end 112 forms a plurality of first ridges each including first and second edges 1121 and 1122 and an apex defined therebetween. The second engaging end 122 forms a plurality of second ridges each including third and fourth edges 1221 and 1222 and an apex defined therebetween respectively. The first and second edges 1121 and 1122 of one of the plurality of first ridges correspondingly face the third and fourth edges 1221 and 1222 of one of the plurality of second ridges. The first and second edges 1121 and 1122 of one of the plurality of first ridges have an included angle of greater than 90 degrees. The third and fourth edges 1121 and 1122 of one of the plurality of second ridges have an included angle of greater than 90 degrees.

The flow guiding mechanism 20 is disposed below the opening 13. The plurality of vanes 21 is disposed along a circumference of the opening 13 one after another, with two adjacent vanes 21 including a spiral air passage 22 formed therebetween. Each of the plurality of vanes 21 has a first extension 211 secured between the first edge 1121 of one of the plurality of first ridges and the third edge 1221 of one of the plurality of second ridges and has a second extension 212 extending from the first extension 211. The air passage 22 between two adjacent vanes 21 is delimited by the second extensions 212 thereof. Each of the plurality of vanes 21 includes the second extension 212 extending from the first extension 211 obliquely. The first and second extensions 211 and 212 have an included angle of greater than 90 degrees. The plurality of vanes 21 is held securely between the first and second base members 11 and 12 with a plurality of joints 1223 which insert through the first extensions 211 of the plurality of vanes 21 and which are fixed to the plurality of securing sections 1123. The plurality of securing sections 1123 is formed on the first base member 11, and the plurality of joints 1223 extends from the second base member 12, respectively. The plurality of securing sections 1123 defines a plurality of apertures, and the plurality of joints 1223 defines a plurality of projections, respectively. However, the present invention is not limited thereto. The plurality of vanes 21 includes a plurality of cavities 2111 which the plurality of joints 1223 insert through. Therefore, the plurality of joints 1223 inserts through the plurality of vanes 21.

Figure 1:
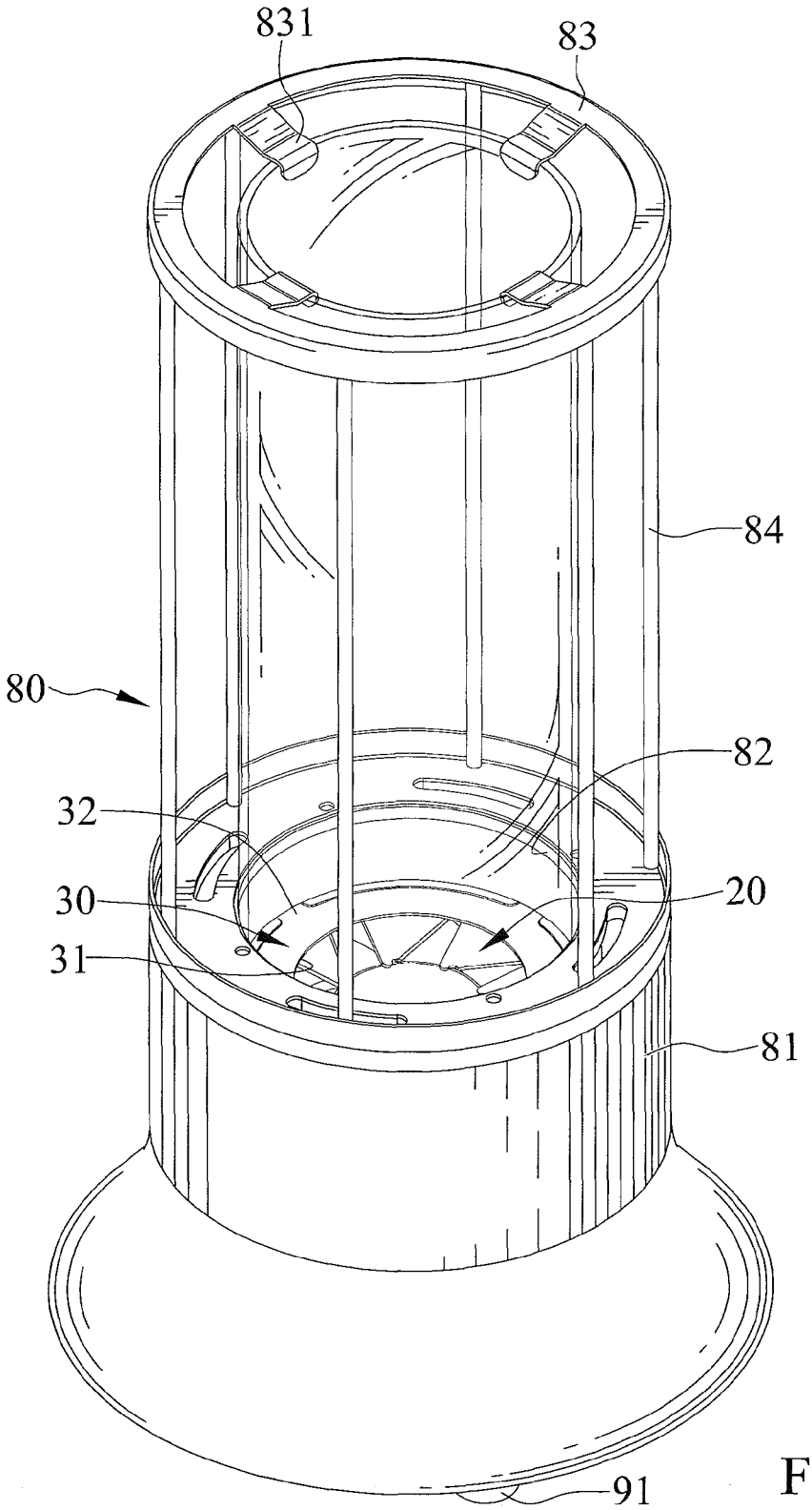
FIG. 1 is a perspective view of an adjustable vortex flame device in accordance with a first embodiment of the present invention.
Figure 2:
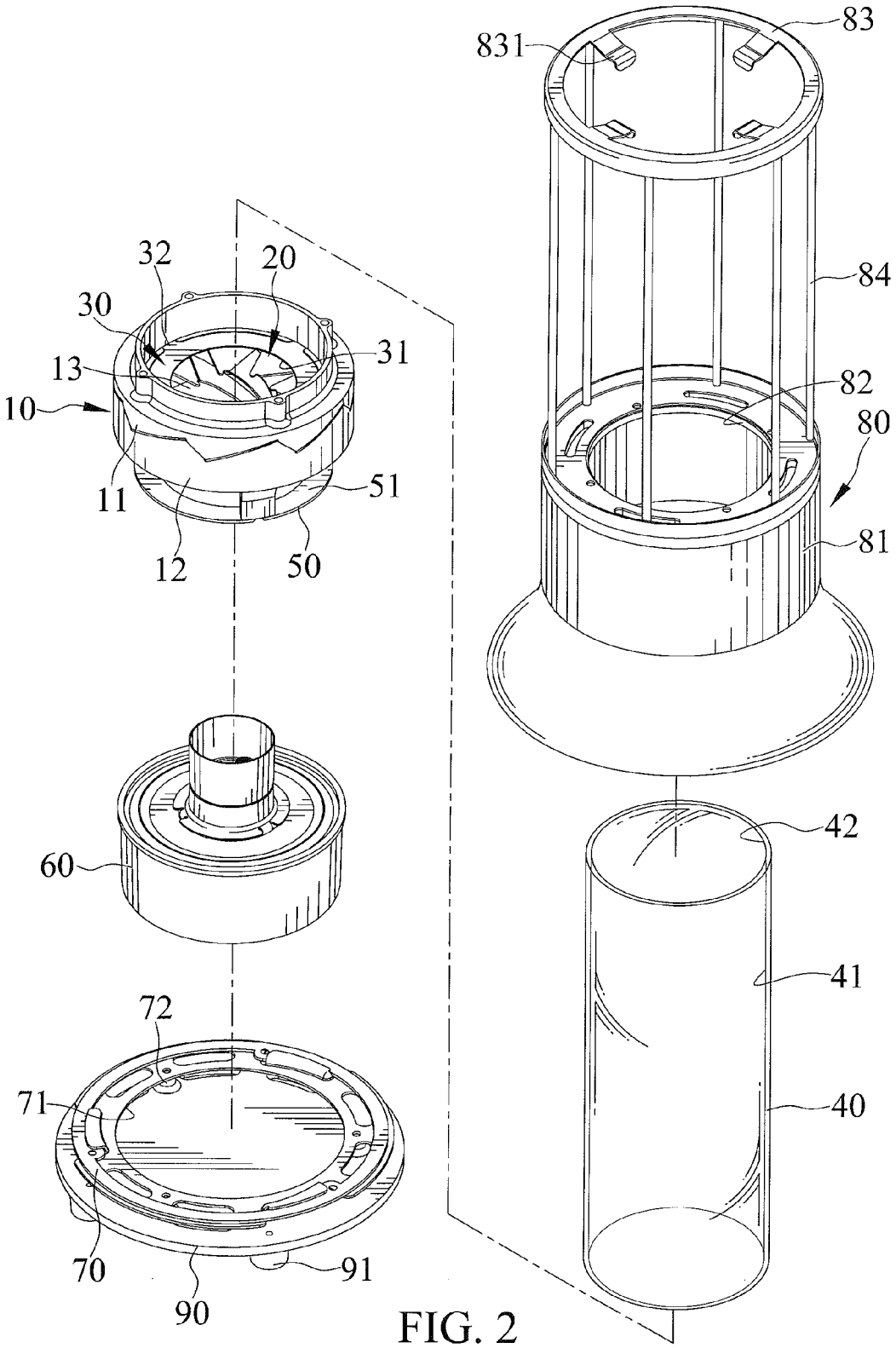
FIG. 2 is an exploded perspective view of the adjustable vortex flame device of FIG. 1.
Figure 3:
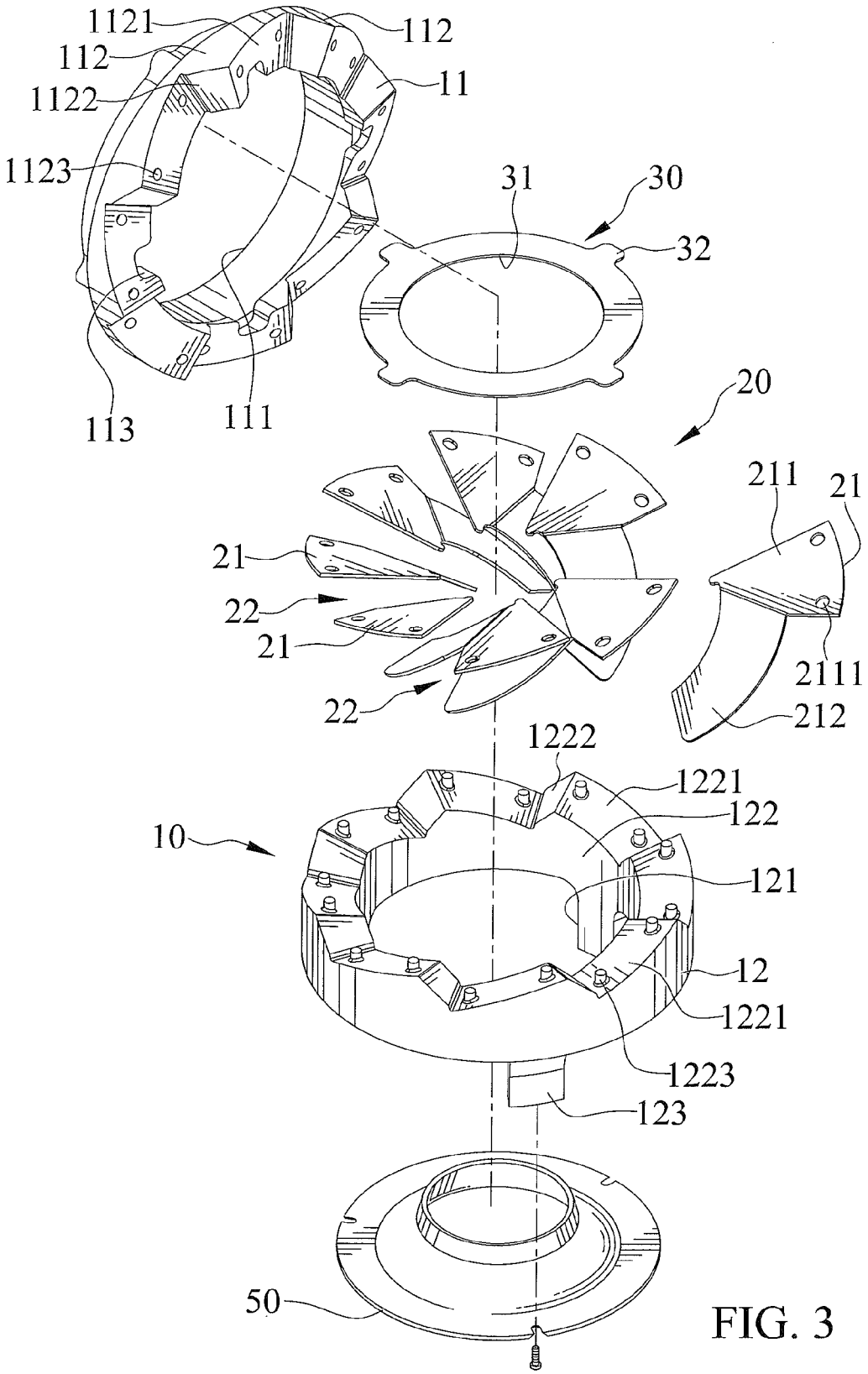
FIG. 3 is another exploded perspective view of the adjustable vortex flame device of FIG. 1.
Figure 4:
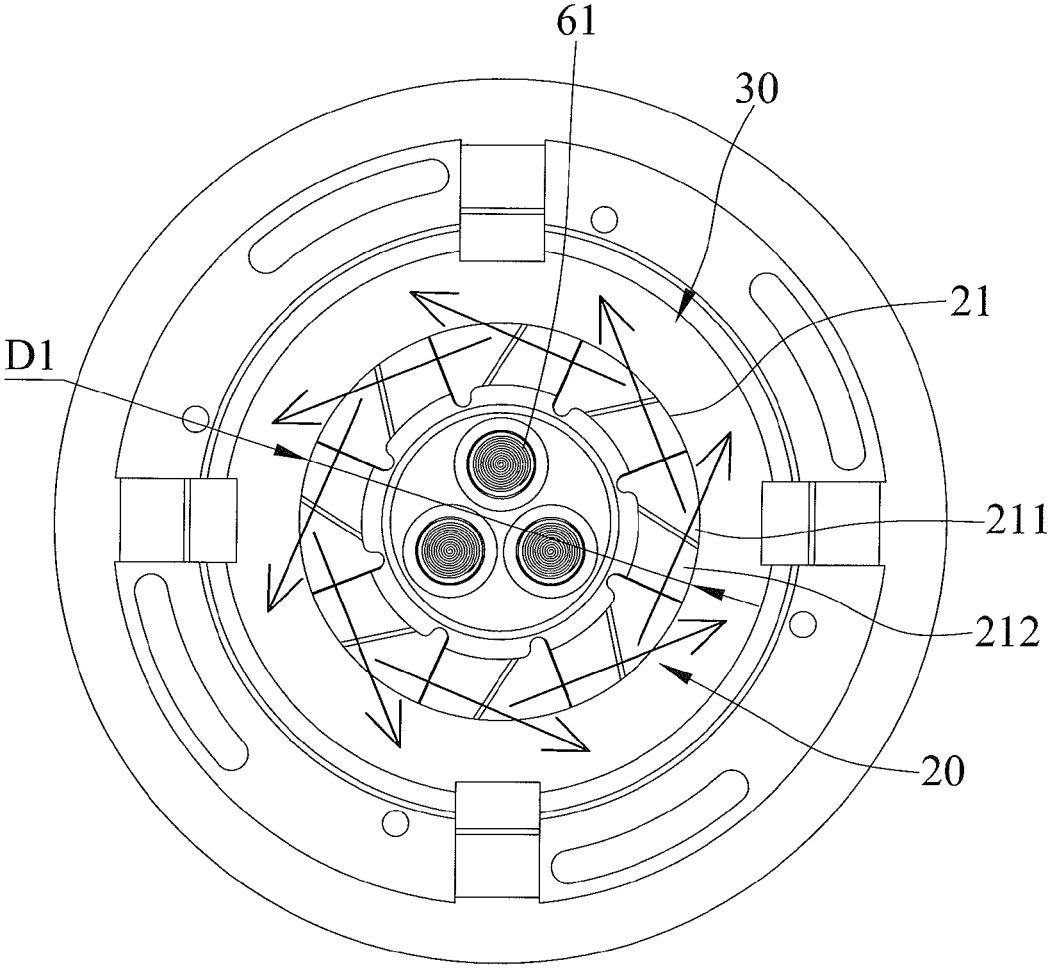
FIG. 4 is a top view of the adjustable vortex flame device of FIG. 1 and arrows indicate air flows.

The control mechanism 30 is an annular member secured to the first base member 11, and the hole 31 is delimited by an inner periphery of the annular member. The first base member 11 has at least one first fixing end 113 connecting with the opening 13, and the control mechanism 30 has at least one second fixing end 32 engaging with the at least one first fixing end 113. FIG. 3 shows the first base member 11 includes a plurality of first fixing ends 113 defining a plurality of slots, and the control mechanism 30 includes a plurality of second fixing ends 32 defining a plurality of projections respectively. In addition, the plurality of first fixing ends 113 is spaced apart from one another circumferentially along the inner periphery of the first base member 11. Likewise, the plurality of second fixing ends is spaced apart from one another circumferentially along the inner periphery of the control mechanism 30.

The hole 31 has a diametrical size which varies with respect to different sizes of vortex flames of the adjustable vortex flame device. The hole 31 corresponds to and is in communication with the opening 13. The hole 31 has a smaller diametrical size than the opening 13.

A hollow and transparent shield 40 is disposed above the control head 10 and adjacent to the control mechanism 30. The shield 40 delimits a space 41 in communication with the hole 31 of the control mechanism 30. The shield 40 has two opposite open ends 42. The space 41 is between the two open ends 42.

A seat 50 with at least one auxiliary air inlet 51 is fixed to and bears the base and with which a fuel reservoir 60 is adapted to connect. The base includes at least one connecting section 123 with which the seat 50 is engaged to mount securely. The seat 50 includes the fuel reservoir 60 engaged therewith, and the fuel reservoir 60 includes a wick 61 and fuel 62, with the wick 61 drawing fuel 62 up into a vortex flame.

A fixing seat 70 has a first bore 71 in which the fuel reservoir 60 is engaged to mount securely on the fixing seat 70 and has a plurality of feet 72 for standing on a surface stably.

A frame 80 defines a housing 81 with a second bore 82 in which the control head 10, the flow guiding and control mechanisms 20 and 30, the seat 50, the fuel reservoir 60, and the fixing seat 70 are received. A securing ring structure 83 secures the shield 40, and at least one supporting structure 84 bears the securing ring structure 83 to a height. The securing ring structure 83 includes a plurality of hooks 831 engaged with the shield 40, and the hooks 831 are spaced apart one after another circumferentially along the inner periphery of the securing ring structure 83.

A pedestal 90 engages with and bears the frame 80. The pedestal 90 includes a plurality of feet 91 that facilitate standing of the pedestal 90 on a surface stably.

Figure 7:
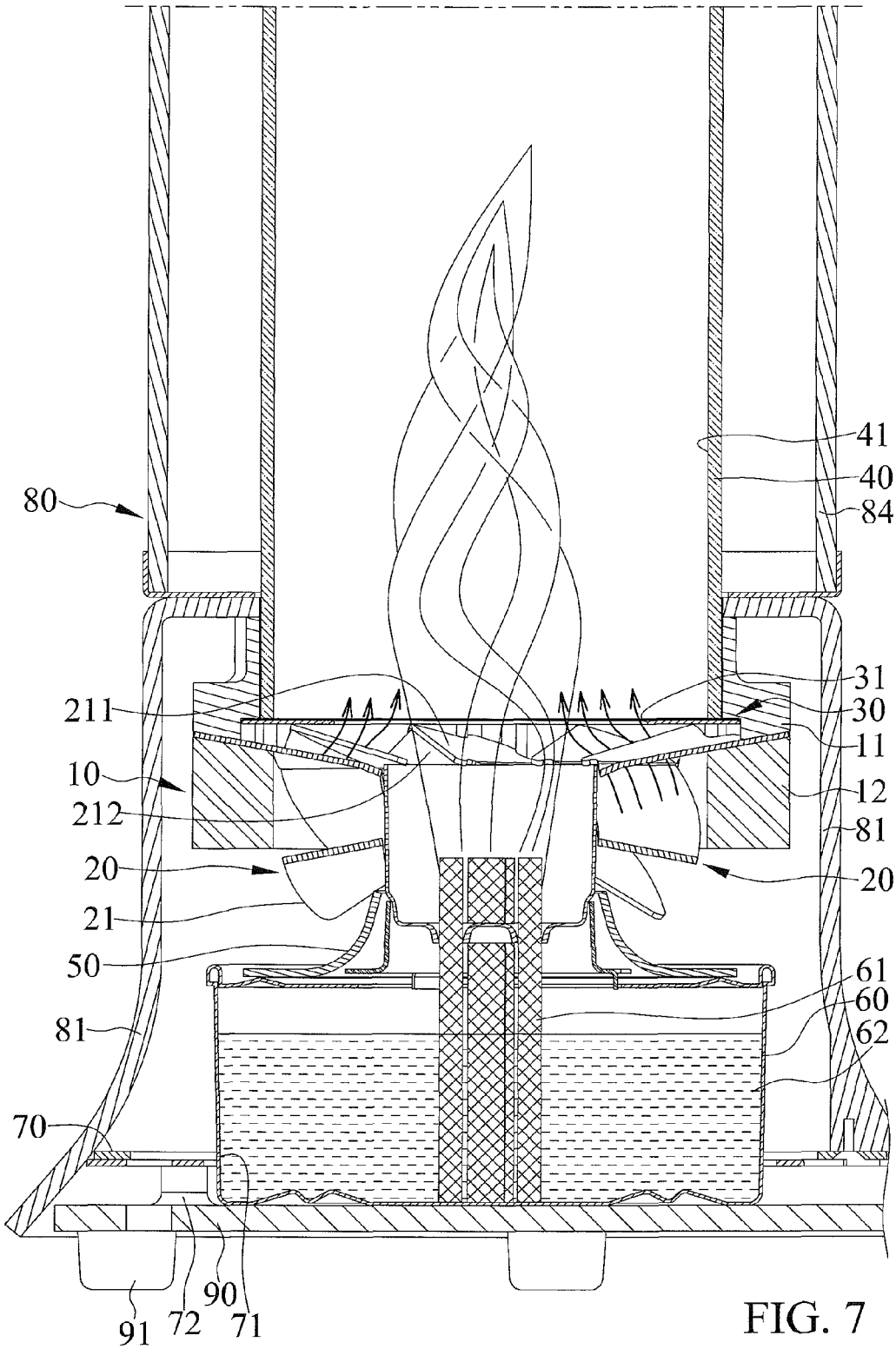
FIG. 7 is a cross-sectional view showing a vortex flame of the adjustable vortex flame device of FIG. 1 and arrows indicate air flows.
Figure 8:
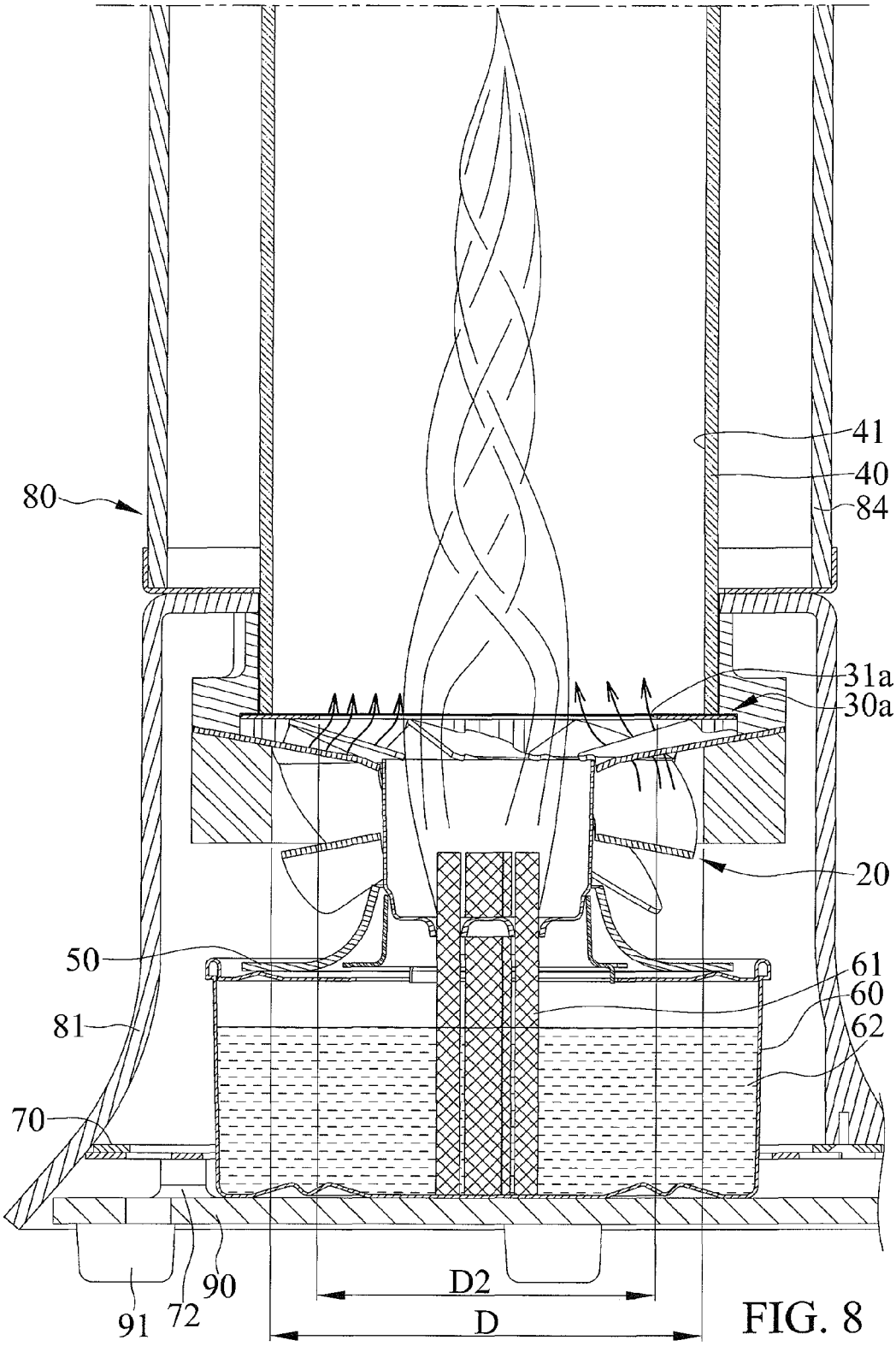
FIG. 8 is a cross-sectional view similar to FIG. 7, except that a hole delimited by a control mechanism of the adjustable vortex flame device is in another size in which a vortex flame of the adjustable vortex flame device is in another size.
Figure 9:
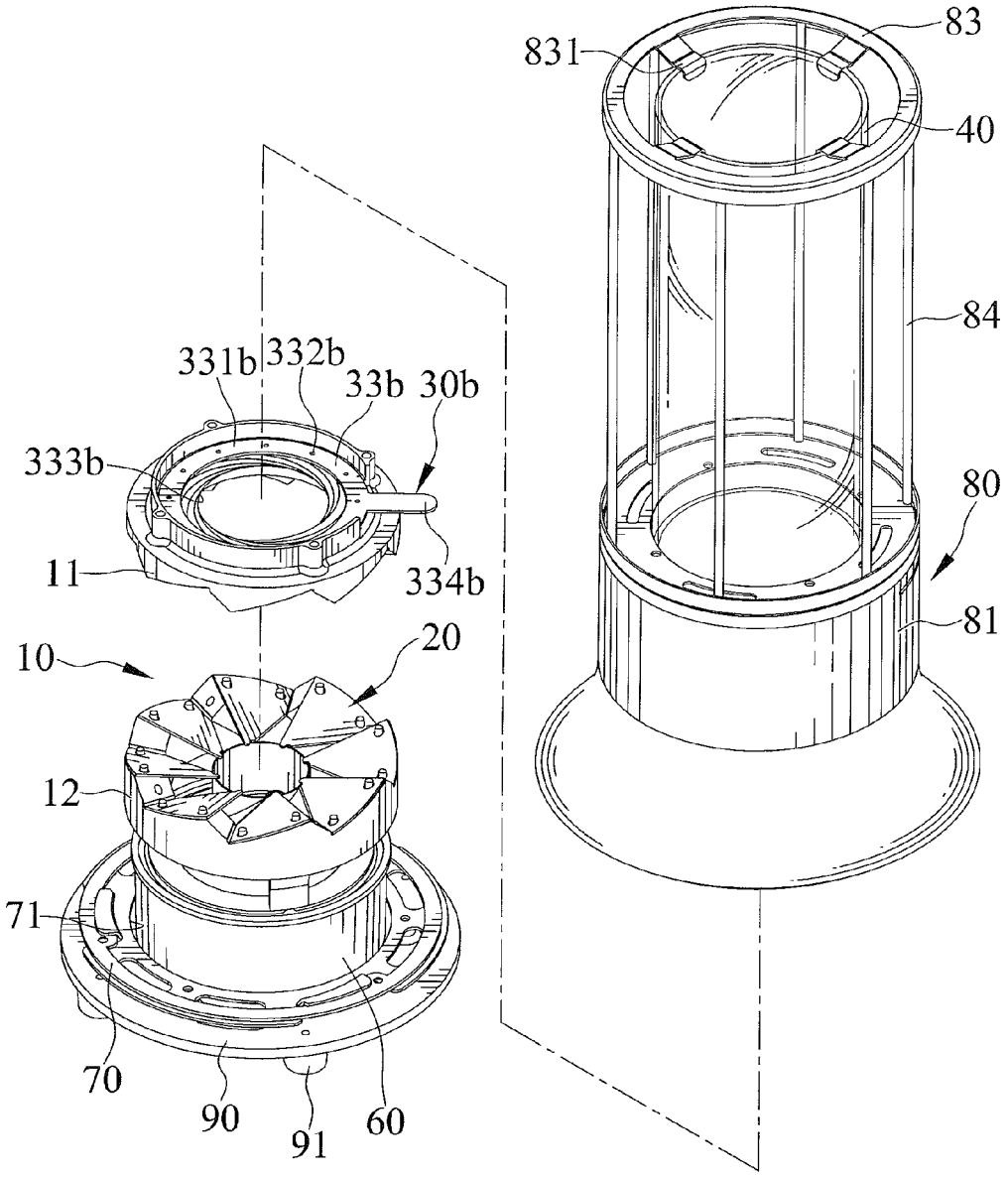
FIG. 9 is an exploded perspective view of an adjustable vortex flame device in accordance with a second embodiment of the present invention.
Figure 10:
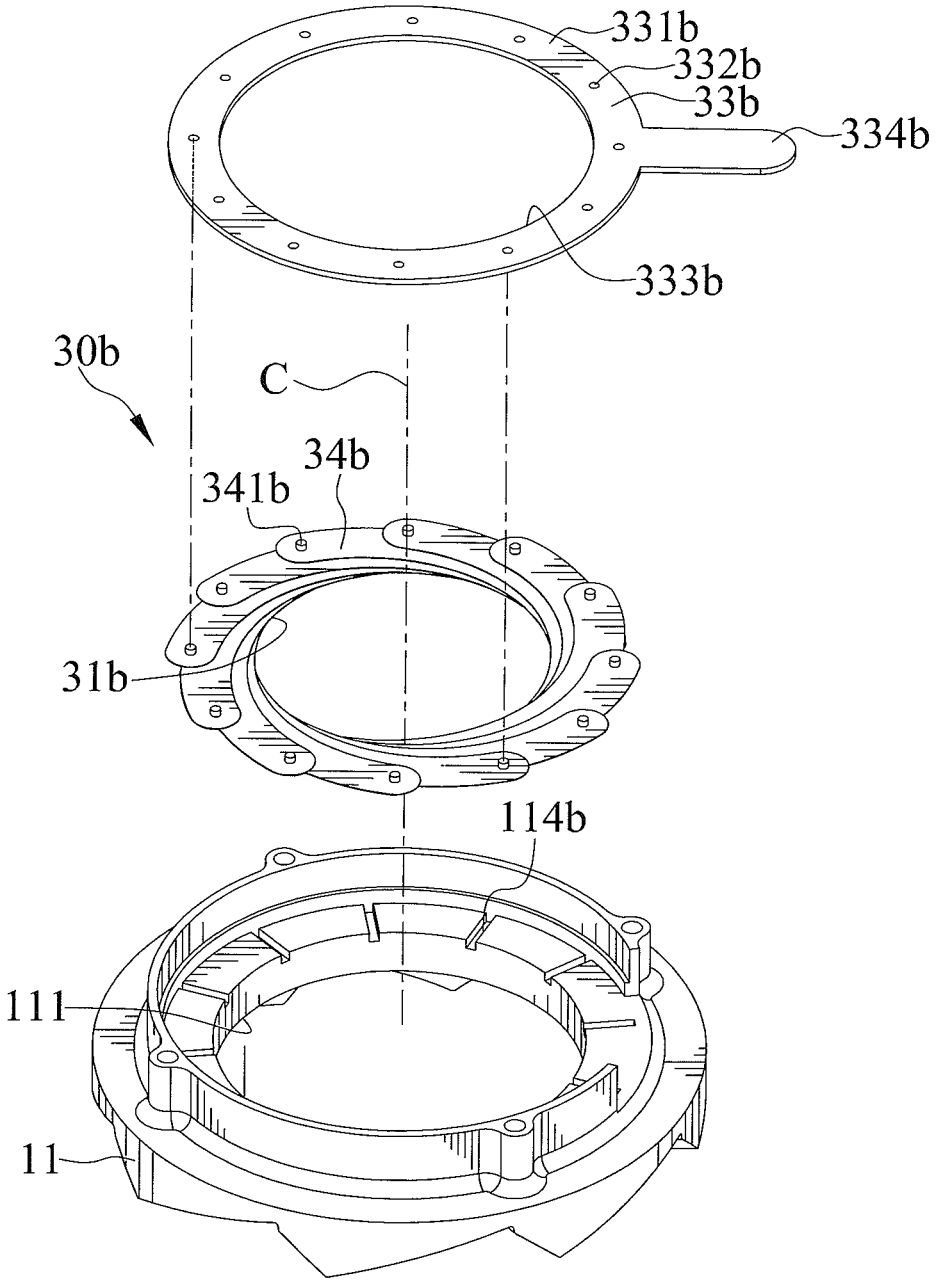
FIG. 10 is another exploded view of the adjustable vortex flame device of FIG. 9.
Figure 11:
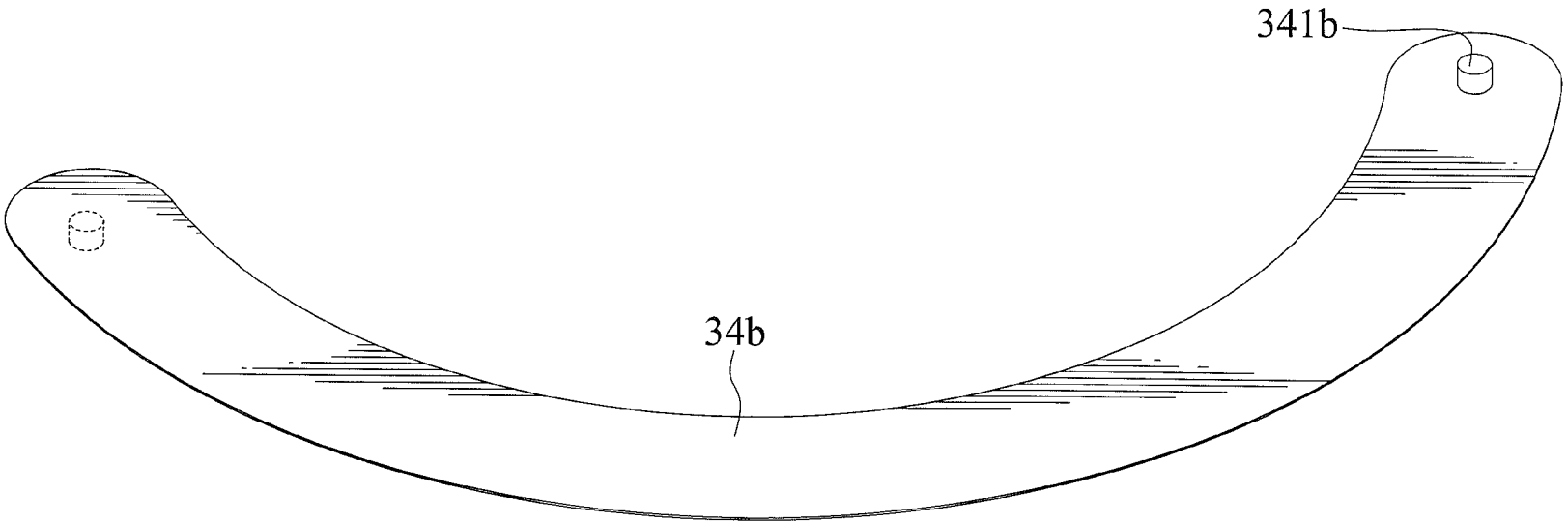
FIG. 11 is a perspective view showing one of a plurality of plates of the control mechanism of the adjustable vortex flame device.
Figure 12:
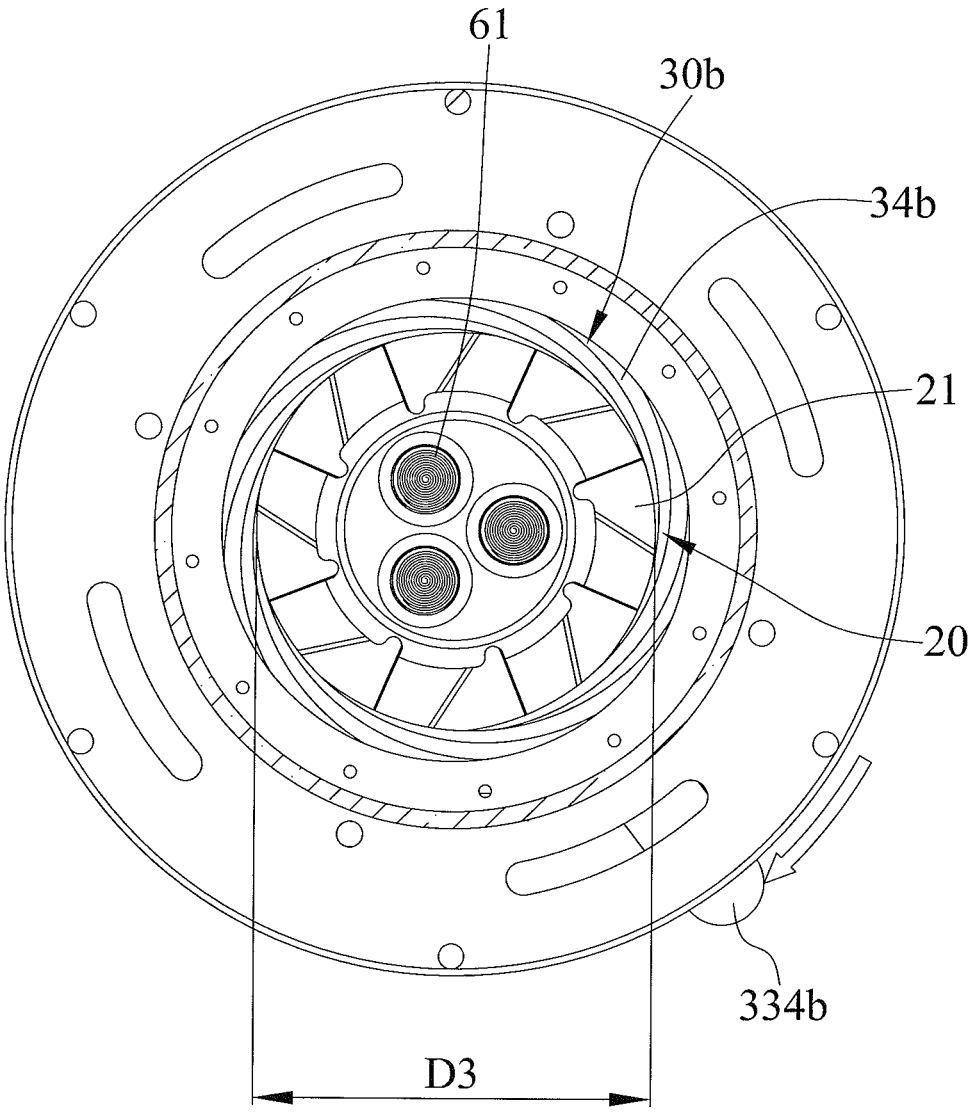
FIG. 12 is a top view of the adjustable vortex flame device of FIG. 9.
Figure 13:
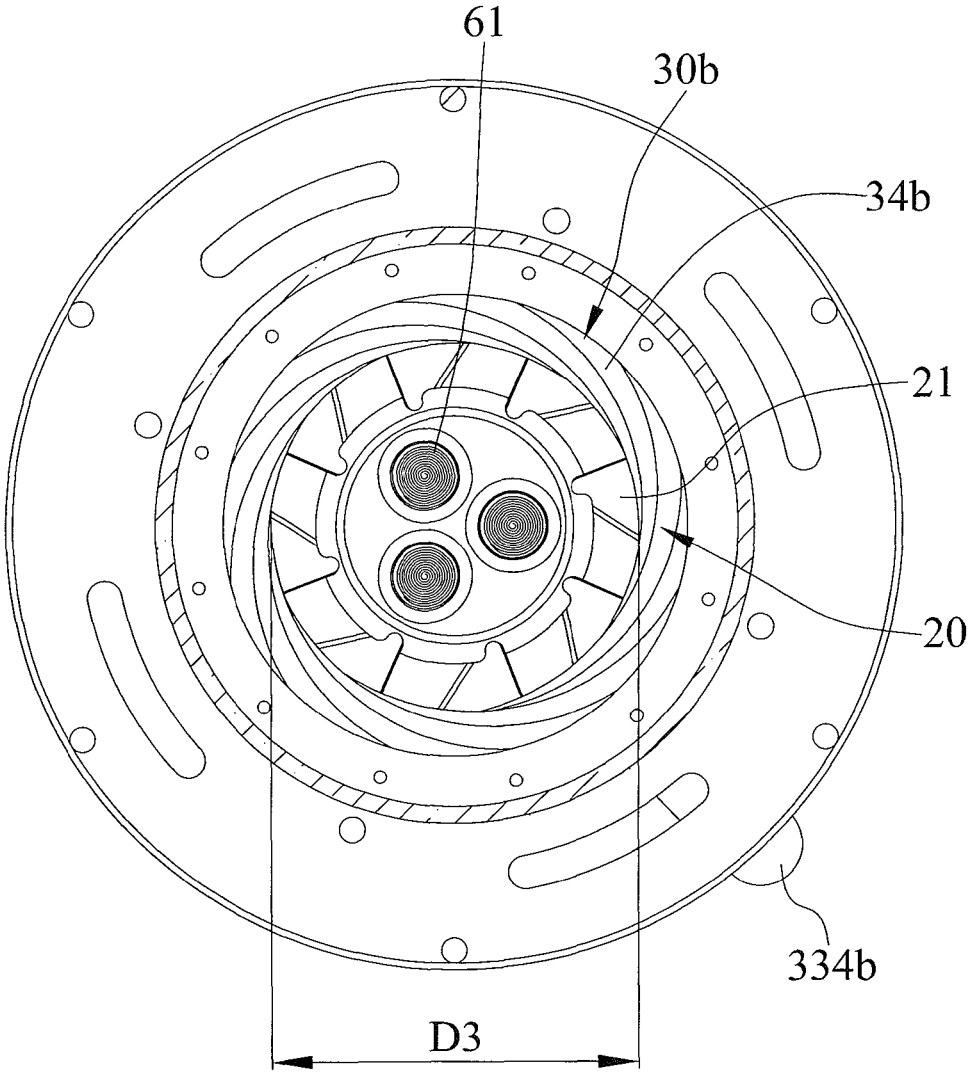
FIG. 13 is a top view showing a control mechanism of the adjustable vortex flame device of FIG. 9 in a setting different from that of FIG. 12.

FIG. 8 is a cross-sectional view similar to FIG. 7, except that a hole 31*a* delimited by a control mechanism 30*a* of the adjustable vortex flame device is in another size in which a vortex flame of the adjustable vortex flame device is in another size. The hole 31*a* has a diametrical size D2, which is greater than the diametrical size D1 of the hole 31. Therefore, a vortex flame of the adjustable vortex flame device shown in FIG. 8 has a larger size than a vortex flame of the adjustable vortex flame device shown in FIG. 7.

FIGS. 9 through 12 show an adjustable vortex flame device in accordance with a second embodiment of the present invention, and the same numbers are used to correlate similar components of the first embodiment, but bearing a letter b. A control mechanism 30*b* includes an actuating member 33*b* and a plurality of plates 34*b*.

The actuating member 33*b* includes an annular structure 331*b*, a plurality of first joining ends 332*b* disposed between inner and outer peripheries of and distributed circumferentially on the annular structure 331*b*, and a through hole 333*b* delimited by the inner periphery of the annular structure 331*b* and corresponding to and in communication with the opening 13. The plurality of first joining ends 332*b* is distanced from one another along a circumferential direction on the annular structure 331*b* equally.

The plurality of plates 34*b* collaboratively delimits the hole 31*b* and is engaged with the actuating member 33*b*. A diametrical size of the hole 31*b* is varied dependent upon different relative positions of the plurality of plates 34*b*, and the actuating member 33*b* is operable to move relative positions of the plurality of plates 34*b*. D3 indicates a diametrical size of the hole 31*b*. The actuating member 33*b* includes a control input 334*b* for facilitating operation thereof. The control input 334*b* defines an extension projection from the annular structure 331*b* of the actuating member 33*b*. The control input 334*b* projects radially away from the outer periphery of the actuating member 33*b*.

Each of the plurality of plates 34*b* has a crescent shape. The plurality of plates 34*b* is stacked together one after another. The actuating member 33*b* is pivotal about an axis of the control head 10, and the plurality of plates 34*b* is rotated circumferentially and selectively moves close to or away from a center axis C of the hole 31*b* with respect to a pivotal movement of the actuating member 33*b*.

Two opposite ends of each of the plurality of plates 34*b* each includes a second joining end 341*b*. Each of the plurality of plates 34*b* includes one second joining end 341*b* engaged with one of the plurality of first joining ends 332*b* and the other second joining end 341*b* engaged with one of a plurality of embedding sections 114*b* of the control head 10. The plurality of embedding sections 114*b* is defined on the base.

The plurality of first joining ends 332*b* defines a plurality of apertures, and the plurality of second joining ends 341*b* defines a plurality of projections respectively. Each of the plurality of plates 34*b* includes a top surface thereof including one of the two projections projecting therefrom and engaged with one of the plurality of apertures and includes a bottom surface thereof including the other of the two projections projecting therefrom engaging with one of the plurality of embedding sections 114*b*. The plurality of embedding sections 114*b* defines a plurality of recesses.

In view of the forgoing, the stack effect occurs in each of the adjustable vortex flame devices, and the negative pressure due to the stack effect in the shield 40 can induce the outside air into the adjustable vortex flame device. The Coanda effect also occurs in each of the adjustable vortex flame devices, with the outside air in the adjustable vortex flame device guided by the plurality of vanes 21 of the flow guiding mechanism 20 to flow spirally in the shield 40 and to attach to an inner peripheral wall of the shield 40. With the flow guiding mechanism 20, the Coanda effect in the adjustable vortex flame device is effective, so a flame of the adjustable vortex flame device is stable and smooth. Furthermore, the control mechanisms 30, 30*a*, and 30*b* delimit the holes 31, 31*a*, and 31*b* which vary with respect to different sizes of vortex flames of the adjustable vortex flame device, and each of the holes 31, 31*a*, and 31*b* is in a smaller diametrical size than the opening 13, so it is obvious to see vorticities of a vortex flame of each of the adjustable vortex flame devices.

While the specific embodiments have been illustrated and described, numerous modifications come to mind without significantly departing from the spirit of invention, and the scope of invention is only limited by the scope of accompanying claims.

What is claimed is:

1. An adjustable vortex flame comprising:

a control head delimiting an opening, with the opening having a diametrical size, wherein the control head includes a base having an inner periphery thereof delimiting the opening, wherein the base includes a first base member and a second base member joined to the first base member, wherein the first base member has a first engaging end and the second base member has a second engaging end engaging with the first engaging end, wherein the first engaging end forms a plurality of first ridges each including first and second edges and an apex defined therebetween, wherein the second engaging end forms a plurality of second ridges each including third and fourth edges and an apex defined therebetween respectively, wherein the first and second edges of one of the plurality of first ridges correspondingly face the third and fourth edges of one of the plurality of second ridges, wherein the first and second edges of one of the plurality of first ridges have an included angle of greater than 90 degrees, wherein the third and fourth edges of one of the plurality of second ridges have an included angle of greater than 90 degrees, with the control head including a flow guiding mechanism including a plurality of vanes, with the plurality of vanes disposed along a circumference of the opening one after another, with two adjacent vanes including a spiral air passage formed therebetween, with the control head including a control mechanism delimiting a hole, with the hole having a diametrical size and which varies with respect to different sizes of vortex flames, with the hole corresponding to and in communication with the opening, with the hole in a smaller diametrical size than the opening, wherein the flow guiding and control mechanisms are mounted on the base; and a hollow and transparent shield disposed above the control head and adjacent to the control mechanism, with the shield delimiting a space in communication with the hole of the control mechanism.

2. The adjustable vortex flame device as claimed in claim 1, wherein the control mechanism includes an actuating member and a plurality of plates, wherein the plurality of plates collaboratively delimits the hole and is engaged with the actuating member, wherein the diametrical size of the hole is varied dependent upon different relative positions of the plurality of plates, and wherein the actuating member is operable to move relative positions of the plurality of plates.

3. The adjustable vortex flame device as claimed in claim 2, wherein each of the plurality of plates has a crescent shape, wherein the plurality of plates is stacked together one after another, wherein the actuating member is pivotal about an axis of the control head, and wherein the plurality of plates is rotated circumferentially and selectively moves close to or away from a center axis of the hole with respect to a pivotal movement of the actuating member.

4. The adjustable vortex flame device as claimed in claim 3, wherein the actuating member includes an annular structure, a plurality of first joining ends disposed between inner and outer peripheries of and distributed circumferentially on the annular structure, and a through hole delimited by the inner periphery of the annular structure and corresponding to and in communication with the opening, wherein two opposite ends of each of the plurality of plates each include a second joining end, and wherein each of the plurality of plates includes one second joining end engaged with one of the plurality of first joining ends and the other second joining end engaged with one of a plurality of embedding sections of the control head.

5. The adjustable vortex flame device as claimed in claim 4, wherein the plurality of first joining ends defines a plurality of apertures and the plurality of second joining ends defines a plurality of projections respectively, wherein each of the plurality of plates includes a top surface thereof including one of the two projections projecting therefrom and engaged with one of the plurality of apertures and a bottom surface thereof including the other of the two projections projecting therefrom engaging with one of the plurality of embedding sections, and wherein the plurality of embedding sections defines a plurality of recesses.

6. The adjustable vortex flame device as claimed in claim 4, wherein the actuating member includes a control input for facilitating operation thereof, with the control input defining an extension projection from the annular structure of the actuating member.

7. The adjustable vortex flame device as claimed in claim 1, wherein each of the plurality of vanes has a first extension secured between the first edge of one of the plurality of first ridges and the third edge of one of the plurality of second ridges and a second extension extending from the first extension, wherein the air passage between two adjacent vanes is delimited by the second extensions thereof, and wherein each of the plurality of vanes includes the second extension extending from the first extension obliquely, with the first and second extensions having an included angle of greater than 90 degrees.

8. The adjustable vortex flame device as claimed in claim 7, wherein the control mechanism is an annular member secured to the first base member, wherein the hole is delimited by an inner periphery of the annular member, wherein the first base member has at least one first fixing end connecting with the opening, and wherein the control mechanism has at least one second fixing end engaging with the at least one first fixing end.

9. The adjustable vortex flame device as claimed in claim 1 further comprising a seat with at least one auxiliary air inlet fixed to and bearing the base and with which a fuel reservoir is adapted to connect, wherein the seat includes the fuel reservoir engaged therewith, and wherein the fuel reservoir includes a wick and fuel, with the wick drawing fuel up into a vortex flame.

10. The adjustable vortex flame device as claimed in claim 9 further comprising a fixing seat with a first bore in which the fuel reservoir is engaged to mount securely on the fixing seat and a plurality of feet for standing on a surface stably, with the fixing seat comprising a frame defining a housing with a second bore in which the control head, the flow guiding and control mechanisms, the seat, the fuel reservoir, and the fixing seat are received, a securing ring structure securing the shield, and at least one supporting structure bearing the securing ring structure to a height, with the at least one supporting structure comprising a pedestal bearing the frame.

11. An adjustable vortex flame device comprising:

a control head delimiting an opening, with the opening having a diametrical size, wherein the control head includes a base having an inner periphery thereof delimiting the opening, with the control head including a flow guiding mechanism including a plurality of vanes, with the plurality of vanes disposed along a circumference of the opening one after another, with two adjacent vanes including a spiral air passage formed therebetween, with the control head including a control mechanism delimiting a hole, with the hole having a diametrical size and which varies with respect to different sizes of vortex flames, with the hole corresponding to and in communication with the opening, with the hole in a smaller diametrical size than the opening, wherein the flow guiding and control mechanisms are mounted on the base;

a hollow and transparent shield disposed above the control head and adjacent to the control mechanism, with the shield delimiting a space in communication with the hole of the control mechanism; and a seat with at least one auxiliary air inlet fixed to and bearing the base and with which a fuel reservoir is adapted to connect, wherein the seat includes the fuel reservoir engaged therewith, and wherein the fuel reservoir includes a wick and fuel, with the wick drawing fuel up into a vortex flame.

12. The adjustable vortex flame device as claimed in claim 11 further comprising a fixing seat with a first bore in which the fuel reservoir is engaged to mount securely on the fixing seat and a plurality of feet for standing on a surface stably, with the fixing seat comprising a frame defining a housing with a second bore in which the control head, the flow guiding and control mechanisms, the seat, the fuel reservoir, and the fixing seat are received, a securing ring structure securing the shield, and at least one supporting structure bearing the securing ring structure to a height, with the at least one supporting structure comprising a pedestal bearing the frame.

13. The adjustable vortex flame device as claimed in claim 11, wherein the control mechanism includes an actuating member and a plurality of plates, wherein the plurality of plates collaboratively delimits the hole and is engaged with the actuating member, wherein the diametrical size of the hole is varied dependent upon different relative positions of the plurality of plates, and wherein the actuating member is operable to move relative positions of the plurality of plates.

14. The adjustable vortex flame device as claimed in claim 13, wherein each of the plurality of plates has a crescent shape, wherein the plurality of plates is stacked together one after another, wherein the actuating member is pivotal about an axis of the control head, and the plurality of plates are rotated circumferentially and selectively move close to or away from a center axis of the hole with respect to a pivotal movement of the actuating member.

15. The adjustable vortex flame device as claimed in claim 14, wherein the actuating member includes an annular structure, a plurality of first joining ends disposed between inner and outer peripheries of and distributed circumferentially on the annular structure, and a through hole delimited by the inner periphery of the annular structure and corresponding to and in communication with the opening, wherein two opposite ends of each of the plurality of plates each includes a second joining end, and wherein each of the plurality of plates includes one second joining end engaged with one of the plurality of first joining ends and the other second joining end engaged with one of a plurality of embedding sections of the control head.

16. The adjustable vortex flame device as claimed in claim 15, wherein the plurality of first joining ends defines a plurality of apertures and the plurality of second joining ends defines a plurality of projections respectively, wherein each of the plurality of plates includes a top surface thereof including one of the two projections projecting therefrom and engaged with one of the plurality of apertures and a bottom surface thereof including the other of the two projections projecting therefrom engaging with one of the plurality of embedding sections, and wherein the plurality of embedding sections define a plurality of recesses.

* * * * *